US006790290B2

(12) United States Patent
Durfee

(10) Patent No.: US 6,790,290 B2
(45) Date of Patent: Sep. 14, 2004

(54) METHOD FOR DISHWASHER VARIABLE FILL CONTROL

(75) Inventor: Anthony L. Durfee, Jackson, TN (US)

(73) Assignee: Maytag Corporation, Newton, IA (US)

( * ) Notice: Subject to any disclaimer, the term of this patent is extended or adjusted under 35 U.S.C. 154(b) by 103 days.

(21) Appl. No.: 10/115,673

(22) Filed: Apr. 4, 2002

(65) Prior Publication Data

US 2003/0188767 A1 Oct. 9, 2003

(51) Int. Cl.[7] ..... A47L 15/46

(52) U.S. Cl. ..... 134/18; 134/25.2; 134/56 R; 134/57 D; 134/56 D; 134/58 R; 134/58 D

(58) Field of Search ..... 134/18, 25.2, 56 R, 134/57 D, 56 D, 58 R, 58 D

(56) References Cited

U.S. PATENT DOCUMENTS 4,178,957 A 12/1979 Hoffman et al.
4,277,290 A 7/1981 Andrews et al.
4,303,406 A 12/1981 Ross
4,408,640 A 10/1983 Voza
5,439,019 A 8/1995 Quandt et al.
5,443,655 A 8/1995 Stover et al.
5,462,606 A 10/1995 Burns
5,634,227 A 6/1997 Lim
5,768,729 A 6/1998 Cracraft
5,806,541 A 9/1998 Cooper et al.
5,904,163 A 5/1999 Inoue et al.
6,029,298 A 2/2000 Dausch et al.

*Primary Examiner*—Zeinab El-Arini
(74) *Attorney, Agent, or Firm*—McKee, Voorhees & Sease, P.L.C.

(57) ABSTRACT

The present invention provides a method and apparatus for a dishwasher having variable fill times. The dishwasher includes a fill volume sensor for sensing that the dishwasher has reached a known fill volume, a timer for timing a period of time between a beginning of fill and the known fill volume being reached, and an intelligent control electrically connected to the fill volume sensor and operatively connected to the timer and adapted for calculating a dishwasher fill rate. According to the present invention, once filling of the dishwasher begins, a sensor is triggered when a known water level and/or fill volume of the dishwasher is reached. The amount of time between initiating the fill and triggering the sensor is measured. A fill rate for the dishwasher is then calculated based on the known fill volume of the dishwasher and the amount of time.

8 Claims, 3 Drawing Sheets

METHOD FOR DISHWASHER VARIABLE FILL CONTROL

BACKGROUND OF THE INVENTION

This invention relates to a method and apparatus for a dishwasher. More specifically, this invention relates to a dishwasher having a control system that provides for variable fill control.

Dishwashers conventionally have provided for the filling of an inner chamber of a dishwasher with water. As disclosed in U.S. Pat. No. 5,806,541 to Cooper, et al., electrically controlled water valves are turned on for one or more periods of time during a wash cycle. Thus in the prior art, the fill of a dishwasher is provided for by turning on a water valve for a set period of time. This period of time is determined by the manufacturer.

One problem with this prior art approach is that the flow rate through the water valve is not necessarily constant. The flow rate of the water valve may be different from the flow rate of the water valve that was used in the dishwasher's design. Furthermore, there may be differences in water pressure from one installation of the dishwasher to another. These differences in the flow rate result in differences in the volume of water that fills a dishwasher. If the dishwasher is under filled with water then items within the dishwasher may not be thoroughly cleaned. If the flow rate is greater than anticipated, then the dishwasher has a greater fill volume than designed for which can result in a waste of water resources as well as unanticipated or undesirable effects on the dishwashing process.

Therefore, it is a primary object of the present invention to provide a method and apparatus for a dishwasher that improves over the state of the art.

It is a further object of the present invention to provide a method and apparatus for a dishwasher that does not need to rely upon fill times that are predefined by a manufacturer.

Yet another object of the present invention is to provide a method and apparatus for a dishwasher that provides for variable water fill volumes without requiring multiple water fill level detectors and without directly sensing water fill rate.

A further object of the present invention is to provide a method and apparatus for a dishwasher that prevents the maximum fill volume of the dishwasher from being exceeded.

Yet another object of the present invention is to provide a method and apparatus for a dishwasher that reduces the effects of disturbances in water supply pressure.

These and other objects, features, or advantages of the present invention will become apparent from the specification and claims that follow.

BRIEF SUMMARY OF THE INVENTION

The present invention is a method and apparatus for a dishwasher having a control system that provides for variable water fill volumes. The dishwasher control system includes a fill volume sensor for sensing that the dishwasher has reached a known fill volume. The dishwasher control system also includes a timer for timing a period of time between the beginning of a fill and the point in time where the known fill volume has been reached. An intelligent control is electrically connected to the fill volume sensor and is operatively connected to the timer. The intelligent control is adapted for calculating a dishwasher fill rate.

Once a fill of the dishwasher begins, the fill continues until the fill volume sensor senses that a known fill volume of the dishwasher is reached. Based on the amount of time between the starting of the fill of a dishwasher and the time at which a known fill volume of the dishwasher is reached, a fill rate is calculated. This fill rate can be used in several different ways. For example, the dishwasher can then be filled with an additional volume of water. This additional volume of water is provided for by calculating an additional period of time at the calculated fill rate. In addition, the calculated fill rate can be averaged with other calculated fill rates in order to determine an average dishwasher fill rate and this average dishwasher fill rate can be used to calculate the amount of time necessary for additional or continued fill.

Thus, the present invention provides the benefits, features, and advantages of providing for proper fill volumes. The actual fill rate of a particular dishwasher installation may vary with water pressure or other factors. The present inventions considers the actual amount of time to reach a predefined fill volume instead of relying on a manufacturer predefined time period. In addition, only one sensor is needed to determine water level or fill volume.

DETAILED DESCRIPTION OF THE INVENTION

Figure 1:
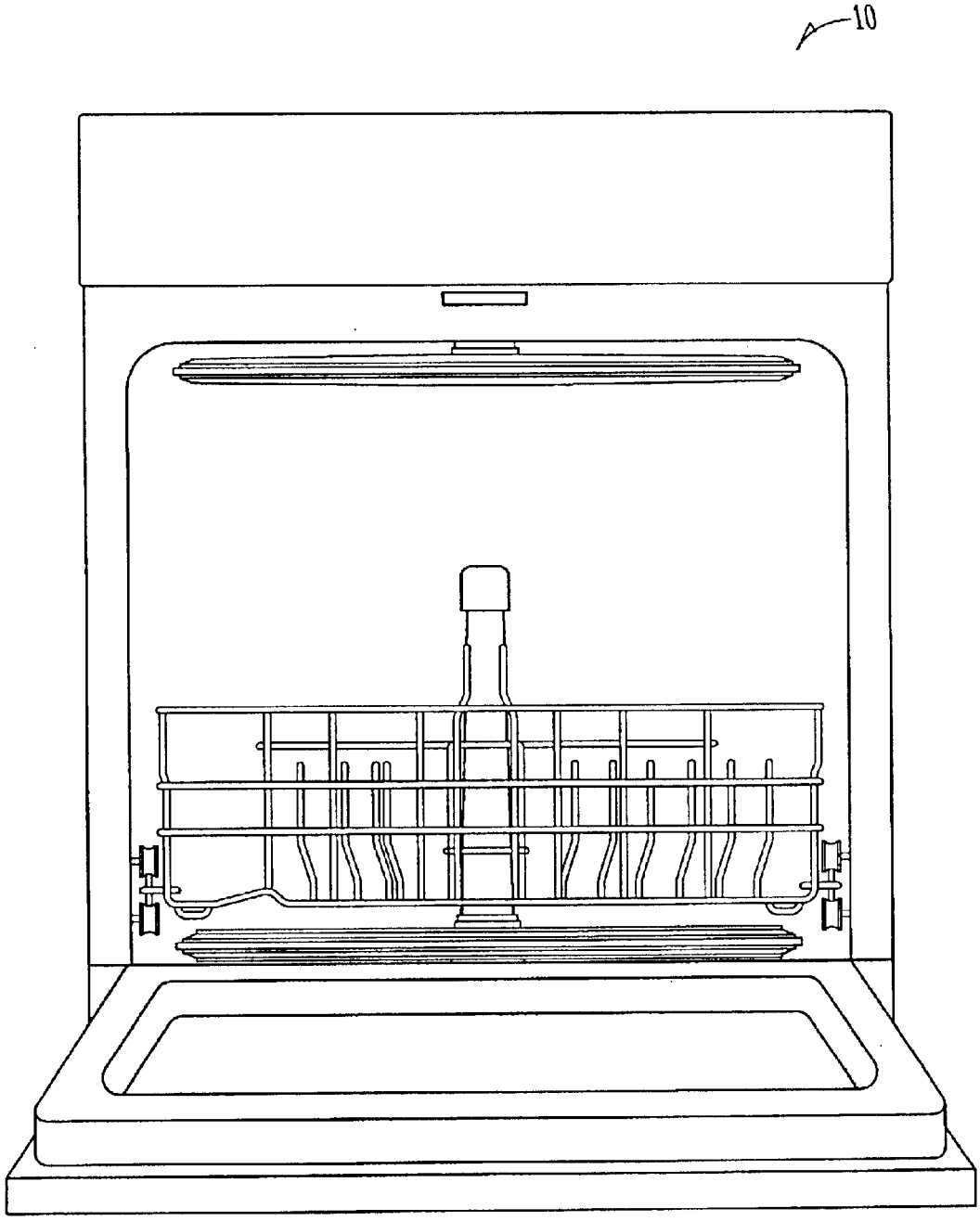
FIG. 1 is a perspective view of a dishwasher according to the present invention.
Figure 2:
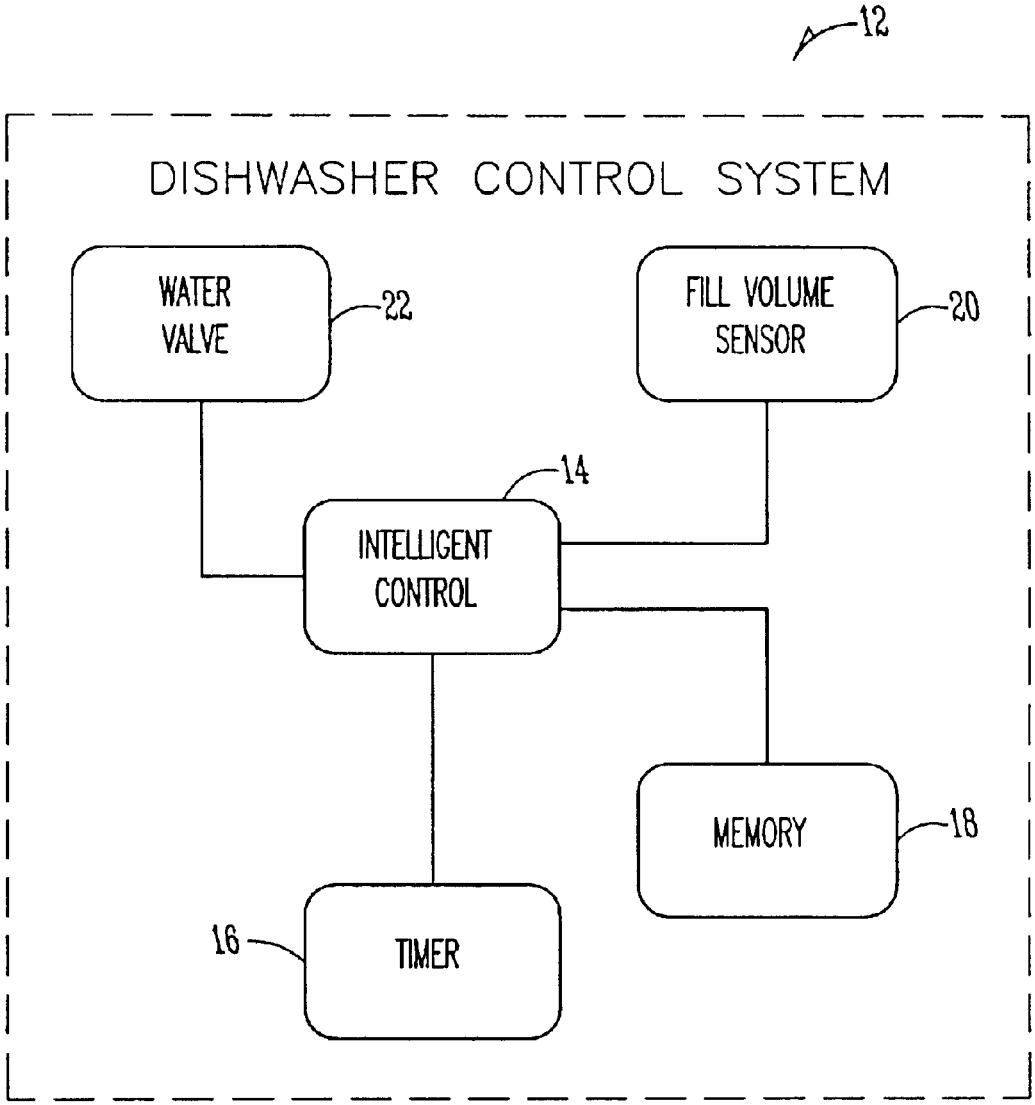
FIG. 2 is a block diagram of the dishwasher according to the present invention.

FIG. 1 illustrates a dishwasher 10. FIG. 2 shows a block diagram of a dishwasher control system 12 within the dishwasher 10. The dishwasher control system 12 includes an intelligent control 14. The intelligent control 14 can be a microcontroller, microprocessor, control circuit, integrated circuit, or other type of intelligent control. The intelligent control 14 is electrically connected to a timer 16. The timer 16 can be a clock, counter, or other type of timer. The intelligent control 14 is also electrically connected to a memory 18. The memory 18 can be of any number of types such as are well known in the art. The present invention further contemplates that the intelligent control 14 can include the timer 16 and the memory 18. For example, where the intelligent control 14 is a microcontroller, the timer 16 and the memory 18 can be built-in functions or features of the intelligent control 14.

The intelligent control 14 is also electrically connected to a fill volume sensor 20 and an electronically controlled water valve 22. Preferably, the fill volume sensor 20 is a water level sensor. The present invention contemplates that the water level sensor may be of various types such as are known in the art, however, preferably the water level sensor is a water level sensor switch or other single position digital level sensor. When the fill volume sensor 20 is triggered, the intelligent control 14 receives an appropriate input such that the intelligent control 14 knows that the corresponding fill volume has been reached. The fill volume sensor 20 is placed so as to trigger when a known fill volume or water level is reached. Thus, the intelligent control 14 knows the fill volume of the dishwasher 10 when the fill volume sensor 20 is triggered. The memory 18 can store a representation of the fill volume at which the fill volume sensor 20 is triggered, or this representation of the known fill volume can be otherwise stored within the intelligent control.

The intelligent control 14 is also electrically connected to an electrically controlled water valve 22. Thus the intelligent control 14 can turn the water valve 22 on or off to provide for filling the dishwasher 10 with water.

Figure 3:
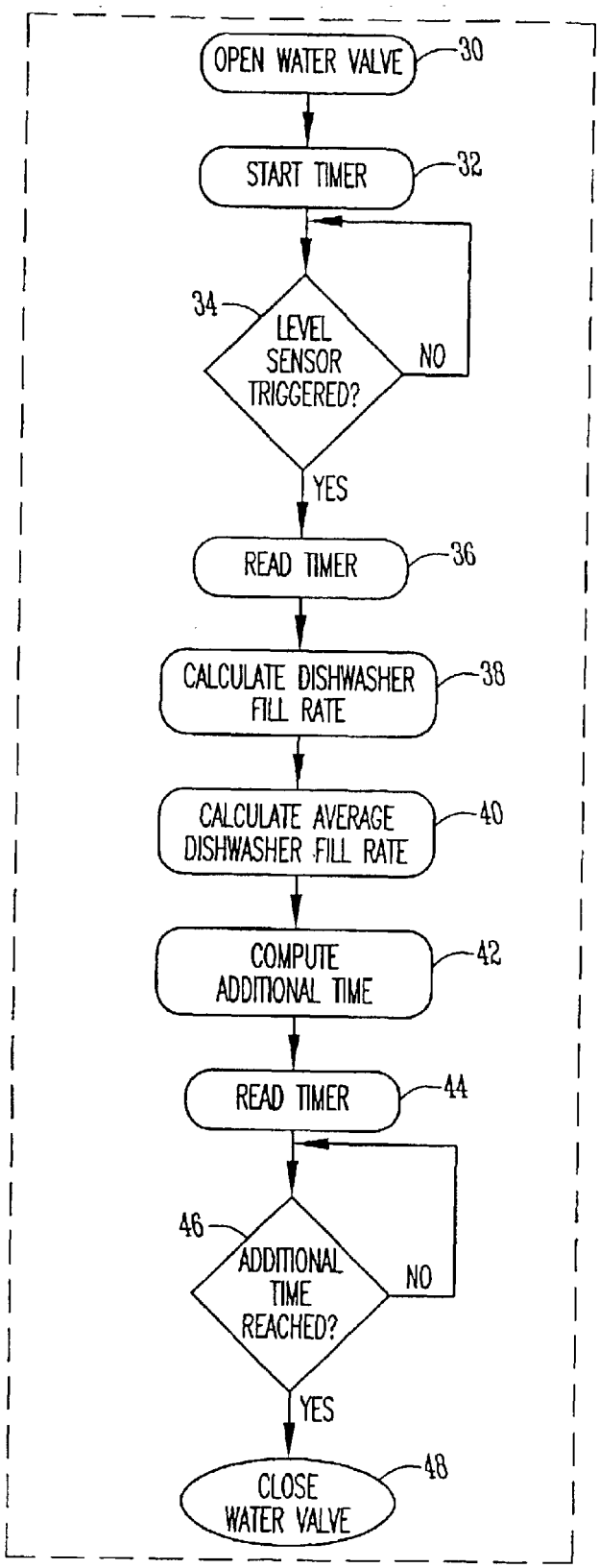
FIG. 3 is a flow chart showing one embodiment of the methodology of the present invention.

FIG. 3 provides a flow chart of one methodology according to the present invention. In step 30 a dishwasher water valve 22 is opened. In step 32 a timer 16 is started or otherwise initiated. In step 34 a determination is made as to whether the fill volume sensor 20, such as a level sensor, has been triggered. If the sensor 20 has not been triggered, then the status of the sensor 20 is checked again. If the sensor 20 has been triggered then the timer is read or examined in step 36. Based on the period of time between when the timer 16 is initiated in step 32 and the time when the sensor 20 has been triggered, a dishwasher fill rate is calculated in step 38. For example, the fill rate is calculated by dividing the fill volume associated with the triggering of sensor 20 by the amount of time between when the water valve was opened and when the sensor 20 was triggered.

From the calculated dishwasher fill rate in step 38, an average dishwasher fill rate can also be calculated in step 40. In order to calculate an average dishwasher fill rate, a plurality of different dishwasher fill rates is averaged.

The present invention also provides for filling the dishwasher beyond the known fill volume associated with the triggering of the sensor 20. The dishwasher can be filled an additional volume by calculating or computing an additional amount of time at the calculated or average fill rate needed in order to result in a desired fill volume. This step of calculating an additional time is shown in step 42. Next, in step 44 and step 46, the additional amount of time is eventually reached and in step 48 the water valve 22 is closed.

Thus, the methodology of the present invention provides for using variable fill times in order to reach a desired fill volume. The present invention only requires a single sensor 20 to monitor fill volume and from this information derives a fill rate. In addition, the present invention can provide for an average fill rate over time. Because the present invention uses the fill rate in order to adjust the amount of time that a valve 22 is opened, the present invention is not susceptible to disturbances in water supply pressure.

Although a preferred embodiment of the present invention is shown, the present invention contemplates numerous variations. For example, in the methodology, the intelligent control need not continuously check whether the fill volume sensor has been activated or whether a particular time has been reached, instead, such an event may be interrupt-driven. In addition, the present invention contemplates that if the timer 16 exceeds a certain value even though the fill volume sensor 20 has not been triggered, the water valve 22 is turned off. Such a variation would be useful in turning off the water valve 22 in the event the fill volume sensor 20 malfunctioned. The present invention contemplates various implementations of and/or selections of the sensor 20 used, the intelligent control 14 used, the configuration of the intelligent control 14, the timer 16, and the memory 18, as well as other variations within the spirit and scope of the present invention.

What is claimed is:

1. A method for providing variable fill control of a dishwasher fill process for a dishwasher using a single water level sensor, comprising:

(a) initiating a fill of the dishwasher;

(b) sensing that a known fill volume of the dishwasher is reached with the water level sensor;

(c) measuring an amount of time between initiating the fill of the dishwasher and sensing that the known fill volume of the dishwasher is reached;

(d) calculating a dishwasher fill rate based on the known fill volume of the dishwasher and the amount of time;

(e) storing the dishwasher fill rate; and (f) filling the dishwasher for an additional period of time based on the dishwasher fill rate, thereby completing the dishwasher fill process.

2. The method of claim 1 further comprising repeating steps (a) through (f) a plurality of times and calculating an average dishwasher fill rate from each of the dishwasher fill rates.

3. A method of providing variable fill control of a fill process for a dishwasher using a single water level sensor, comprising:

opening a water valve to allow water to enter the dishwasher at a first time;

starting a timer at the first time;

sensing triggering of the water level sensor at a second time;

associating a known fill volume with the water level sensor;

calculating a dishwasher fill rate at least partially based on a difference between the first time and the second time and based on the known fill volume;

storing the dishwasher fill rate; and adding additional water to the dishwasher by calculating an amount of time at the dishwasher fill rate needed to yield an additional fill volume, thereby completing the fill process.

4. The method of claim 3 wherein the dishwasher fill rate is an average dishwasher fill rate.

5. The method of claim 3 wherein a sum of the known fill volume and the additional fill volume is less than a maximum dishwasher fill volume.

6. A method for providing variable fill control of a dishwasher fill process using a single water level sensor, comprising:

(a) initiating a fill of the dishwasher by opening a water valve;

(b) sensing that a known fill volume of the dishwasher is reached with the water level sensor;

(c) measuring an amount of time between initiating the fill of the dishwasher and sensing that the known fill volume of the dishwasher is reached;

(d) calculating a dishwasher fill rate based on the known fill volume of the dishwasher and the amount of time;

(e) storing the dishwasher fill rate;

(f) calculating an additional period time at least partially based on the dishwasher fill rate;

(g) filling the dishwasher for the additional period of time;

(h) closing the water valve of the dishwasher thereby completing the dishwasher fill process.

7. The method of claim 6 wherein the step of calculating an additional period of time is partially based on a previously stored dishwasher.

8. The method of claim 6 further comprising closing the water valve if the amount of time measured in step (c) exceeds a threshold value.

* * * * *